US011497336B2

(12) United States Patent
Needler

(10) Patent No.: US 11,497,336 B2
(45) Date of Patent: Nov. 15, 2022

(54) CONTAINER AND SYSTEM

(71) Applicant: IPARCELBOX LTD, London (GB)

(72) Inventor: Paul Needler, London (GB)

(73) Assignee: IPARCELBOX LTD

( * ) Notice: Subject to any disclaimer, the term of this patent is extended or adjusted under 35 U.S.C. 154(b) by 0 days.

(21) Appl. No.: 17/047,175

(22) PCT Filed: Aug. 23, 2019

(86) PCT No.: PCT/EP2019/072546
§ 371 (c)(1),
(2) Date: Oct. 13, 2020

(87) PCT Pub. No.: WO2020/048791
PCT Pub. Date: Mar. 12, 2020

(65) Prior Publication Data

US 2021/0321807 A1 Oct. 21, 2021

(30) Foreign Application Priority Data

Sep. 5, 2018 (GB) ..... 1814441
Jan. 31, 2019 (GB) ..... 1901340

(51) Int. Cl.
*A47G 29/14* (2006.01)
*G07C 9/00* (2020.01)

(52) U.S. Cl.
CPC ..... *A47G 29/141* (2013.01); *G07C 9/00309* (2013.01); *G07C 9/00912* (2013.01); *A47G 2029/149* (2013.01); *G07C 2209/62* (2013.01)

(58) Field of Classification Search
None
See application file for complete search history.

(56) References Cited

U.S. PATENT DOCUMENTS 10,586,410 B2 * 3/2020 Wang ..... G06Q 50/12
2001/0045449 A1 11/2001 Shannon
(Continued)

FOREIGN PATENT DOCUMENTS

CA 2967947 11/2017
CN 203597763 5/2014
(Continued)

OTHER PUBLICATIONS

Iparcelbox Ltd; Office Action for European patent application No. 19758956.7, dated May 25, 2021, 4 pgs.
(Continued)

*Primary Examiner* — Carlos Garcia
(74) *Attorney, Agent, or Firm* — Taylor English Duma LLP

(57) ABSTRACT

There is disclosed a container comprising a container portion for storing one or more items. The container portion is accessible via a movable closure. The container portion also comprises an input device and a lock for selectively configuring the container portion in a locked state or an unlocked state. The container also comprises a communication module for communicating with a user device of a user. A controller is configured such that, in response to actuation of the input device when the container portion is in the locked state, the controller causes a request for access to the container portion to be sent by the communication module to the user device of a user only on condition that one or more items is determined by the controller to be present in the container portion.

21 Claims, 8 Drawing Sheets

(56) References Cited

U.S. PATENT DOCUMENTS

| | | | | |
|---|---|---|---|---|
| 2002/0178016 | A1 | 11/2002 | Mclellan | |
| 2004/0252018 | A1 | 12/2004 | Shuster | |
| 2014/0014008 | A1 | 1/2014 | Tompkins | |
| 2015/0199857 | A1 | 7/2015 | Mackin | |
| 2016/0050191 | A1 | 2/2016 | Alt | |
| 2016/0300187 | A1* | 10/2016 | Kashi | G06Q 10/0832 |
| 2018/0033235 | A1* | 2/2018 | Dotterweich | G07F 17/12 |
| 2018/0220827 | A1 | 8/2018 | Romanucci | |
| 2019/0114585 | A1* | 4/2019 | Fee | G06Q 10/0836 |
| 2019/0180545 | A1* | 6/2019 | Tsujimura | G07C 9/00896 |
| 2019/0283962 | A1* | 9/2019 | Skaaksrud | G05D 1/0287 |
| 2020/0258035 | A1* | 8/2020 | Fujisawa | G06Q 50/28 |

FOREIGN PATENT DOCUMENTS

| | | | | |
|---|---|---|---|---|
| CN | 107989514 | | 5/2018 | |
| DE | 102015104680 | | 9/2016 | |
| EP | 2835078 | | 2/2015 | |
| GB | 2522287 | | 7/2015 | |
| GB | 2577140 | | 3/2020 | |
| GB | 2576894 | | 1/2021 | |
| WO | 0100069 | | 1/2001 | |
| WO | 2014182636 | | 11/2014 | |
| WO | WO-2017156776 | A1 * | 9/2017 | A47G 29/141 |
| WO | 2018212821 | | 11/2018 | |

OTHER PUBLICATIONS

Needler, Paul; International Search Report and Written Opinion for PCT/EP2019/072546, filed Aug. 23, 2019, dated Nov. 22, 2019, 10 pgs.

Needler, Paul; Examination Report response for United Kingdom application No. GB1901340.8, filed Dec. 2, 2020, 57 pgs.

Needler, Paul; Examination Report for United Kingdom application No. GB1901340.8, dated Oct. 23, 2020, 3 pgs.

Needler, Paul; Examination Report response for United Kingdom application No. GB1814441.0, filed Apr. 15, 2020, 49 pgs.

Needler, Paul; Examination Report for United Kingdom application No. GB1814441.0, dated Mar. 23, 2020, 4 pgs.

Needler, Paul; Examination Report response for United Kingdom patent application No. GB1901340.8, filed Sep. 20, 2019, 63 pgs.

Needler, Paul; Examination Report response for United Kingdom patent application No. GB1814441.0, filed Aug. 8, 2019, 51 pgs.

Needler, Paul; Examination Report for United Kingdom patent application No. GB1901340.8, dated Jul. 29, 2019, 9 pgs.

Needler, Paul; Examination Report for United Kingdom patent application No. GB1814441.0, dated Jul. 8, 2019, 7 pgs.

Iparcelbox Ltd; Third Party Observations for European application No. 19758956.7, dated Oct. 11, 2021, 4 pgs.

* cited by examiner

CONTAINER AND SYSTEM

FIELD OF THE INVENTION

The application relates to a container for securely storing one or more items, such as parcels or the like, and a system comprising such a container.

BACKGROUND

It is known for people to order items that need to be delivered to their home or office. A problem exists when there is no-one available at the delivery address to accept the items. In such situations the delivery person often returns the items to a depot for subsequent collection by the intended recipient. This is inconvenient. Alternatively a designated "safe-place" is agreed beforehand between the recipient and the sender of the items (or the delivery service). The safe-place may be for example a rear door-step or an unlocked box. Such safe-places may lack the necessary security to stop thieves from stealing the delivered items.

STATEMENT OF INVENTION

According to a first aspect there is provided a container comprising: a container portion for storing one or more items, the container portion being accessible via a movable closure; an input device; a lock for selectively configuring the container portion in a locked state or an unlocked state; a communication module for communicating with a user device of a user; and a controller configured such that, in response to actuation of the input device when the container portion is in the locked state, the controller causes a request for access to the container portion to be sent by the communication module to the user device of a user only on condition that one or more items is determined by the controller to be present in the container portion.

According to an example, the controller is configured to determine that one or more items is present in the container portion based on stored information of earlier events.

According to an example, the stored information of earlier events comprises information that the container portion has been previously configured in the unlocked state, and whilst in the unlocked state the closure has been opened and closed.

According to an example, the container comprises a sensor for sensing whether an item is present in the container portion.

According to an example, the controller is configured to determine that one or more items is present in the container portion based on information received from the sensor.

According to an example, the sensor comprises one or more of: an optical sensor; a camera; a switch; a weighing scales.

According to an example, the communication module is configured to receive a response from the user device, the controller configured to configure the container portion in the unlocked state, when the response from the user device grants access to the container portion.

According to an example, the controller is configured to configure the container portion in the unlocked state for a first predetermined time period when the response from the user device grants access to the container portion, and to return the container portion to the locked state after the first predetermined time period has expired.

According to an example, the communication module is configured to receive an instruction from the user device to configure the container portion in the unlocked state irrespective of whether the input device has been actuated, the controller configured to configure the container portion in the unlocked state in response to receiving the instruction.

According to an example, the communication module is configured to receive an instruction from the user device to configure the container portion in the unlocked state irrespective of whether the input device has been actuated, the controller configured to place the container portion in the unlocked state for a second predetermined time period in response to receiving the instruction, the second predetermined time period being different than the first predetermined time period.

According to an example, the first and second predetermined time periods are configurable by the user.

According to an example, the controller is configured to retain the container portion in the locked state, when a response from the user device denies access to the container portion or when there is no response from the user device.

According to an example, the controller is configured to configure the container portion in the unlocked state without communicating with the user device of the user, when it is determined by the controller that no items are present in the container portion.

According to an example, the container comprises a camera configured to obtain one or more images of the container and/or a surrounding area of the container, the camera configured to make the obtained images available for transmission to the user device of the user.

According to an example, the input device comprises a button or a touch-sensitive pad.

According to an example, the container comprises a visual display for displaying whether the container is in the locked state or the unlocked state.

According to an example, the container comprises only a single closure and only a single container portion.

According to an example, the closure comprises a lid or a door.

According to an example, the communication module configured for communicating with a server serving the container; and wherein the controller is configured to enable access to the container portion, in response to an indication received from the server of authentication of a token.

According to an example, the controller configured to configure the container portion in the unlocked state in response to detecting proximity of an authorised device.

According to a second aspect there is provided a system comprising: a container according to the first aspect, and a user device for communicating with the communication module of the container.

According to an example, the user device comprises a user interface via which a user can perform one or more of: grant or deny access to the container portion in response to a received request for access to the container portion; configure the container portion in the locked state or the unlocked state irrespective of whether a request for access to the container portion has been received; view images of the container and/or a surrounding area of the container; obtain information of a quantity of items in the container portion; adjust one or more settings of the container.

According to an example, the camera is spaced from the container and the camera configured to obtain one or more images of the container and/or a surrounding area of the container.

According to a third aspect there is provided a method comprising: receiving user input at an input device of a container that is in a locked state; and in response to the user input, causing a request for access to a container portion of the container to be sent to a user device of a user only on condition that one or more items is determined to be present in the container portion.

According to an example, the determination that one or more items is present in the container portion comprises using stored information of earlier events, the stored information comprising information that the container portion has been previously configured in an unlocked state, and whilst in the unlocked state a closure of the container portion has been opened and closed.

According to an example, the method comprises sending a notification to the user device of the user when it is determined that one or more items has been placed in the container portion.

According to a fourth aspect there is provided a computer program comprising program code means adapted to perform the method of the third aspect when the program is run on a data processing apparatus.

According to a fifth aspect there is disclosed a system comprising: a container portion for storing one or more items, the container portion being accessible via a movable closure, the container comprising a lock for selectively configuring the container portion in a locked state or an unlocked state; a first device configured to generate a token; a second device configured to use a token generated by the first device so as to cause the container portion to be configured in the unlocked state, to enable access to the container portion.

According to an example the system comprises a first server configured to authenticate a token.

According to an example the container portion is configured to be placed in the unlocked state or in a state such that it can be unlocked by operation of an input device on the container, in response to receiving an indication from the first server that a token has been authenticated.

According to an example the system comprises a second server for serving the second device.

According to an example the second server is configured to receive and securely store a token generated by the first device, and the second device is configured to obtain the token from the second server.

According to an example the second server is configured to authenticate the second device prior to providing the token to the second device.

According to an example the second device is configured to obtain the token from the first device via one or more of: text message; email; REST API.

According to an example the first device comprises a user device of a first user.

According to an example the second device comprises a user device of a second user.

According to an example the second device comprises an unmanned mobile device.

According to an example the unmanned mobile device comprises an unmanned aerial vehicle or a robot.

According to an example the second device is configured to obtain information of the container, and in response to obtaining the information of the container the second device is configured to transmit a request for a token.

According to an example the second device is configured to obtain the information of the container by one or more of: Bluetooth®; Wi-Fi®; scanning a barcode on the container.

According to an example the first device is configured to generate multiple tokens for multiple respective users.

According to an example the token comprises one or more adjustable properties, the one or more adjustable properties comprising one or more of: access type; whether the token is single or multi-use; a name of the token.

According to an example the access type comprises one or more of: access to deliver an item to the container; access to collect an item from the container; access to empty the container.

According to an example the container is configured to be unlocked in response to detecting proximity of the second device, once the second device has been authorised.

According to a sixth aspect there is provided a method comprising: generating a token at a first device; a second device using a token generated by the first device in order to enable access to a container portion of a container for storing one or more items, the container portion being accessible via a movable closure and the container comprising a lock for selectively configuring the container portion in a locked state or an unlocked state, the enabling access to the container portion comprising configuring the container portion in the unlocked state.

According to a seventh aspect there is provided a computer program comprising code means adapted to perform the method of the first aspect when the program is run on a data processing apparatus.

According to an eighth aspect there is provided a container comprising: a controller; a container portion for storing one or more items, the container portion being accessible via a movable closure; a lock for selectively configuring the container portion in a locked state or an unlocked state; a communication module for communicating with a server serving the container; and wherein the controller is configured to enable access to the container portion, in response to an indication received from the server of authentication of a token.

According to an example, the enabling access to the container portion comprises configuring the container portion in the unlocked state, or configuring the container portion in a state such that it can be unlocked by operation of an input device on the container.

According to an example, the controller is configured to configure the container portion in the unlocked state in response to detecting proximity of an authorised device.

According to a ninth aspect there is provided a method of controlling a container having a container portion for storing one or more items, comprising: enabling access to the container portion in response to receiving an indication from a server serving the container that a token has been authenticated.

According to a tenth aspect there is provided a computer program comprising code means adapted to perform the method of the ninth aspect when the program is run on a data processing apparatus.

According to an eleventh aspect there is provided a container comprising: a container portion for storing one or more items, the container portion being accessible via a movable closure; an input device; a lock for selectively configuring the container portion in a locked state or an unlocked state; a communication module for communicating with a user device of a user; and the controller configured such that, in response to actuation of the input device when the container portion is in the locked state, the controller causes a request for access to the container portion to be sent by the communication module to the user device of a user when at least one condition is met, the at least one condition being that one or more items is determined by the controller to be present in the container portion.

According to a twelfth aspect there is provided a method comprising: receiving user input at an input device of a container that is in a locked state; and in response to the user input, causing a request for access to the container portion to be sent to a user device of a user when at least one condition is met, the at least one condition comprising a determination that one or more items is present in the container portion.

DETAILED DESCRIPTION

Figure 1:
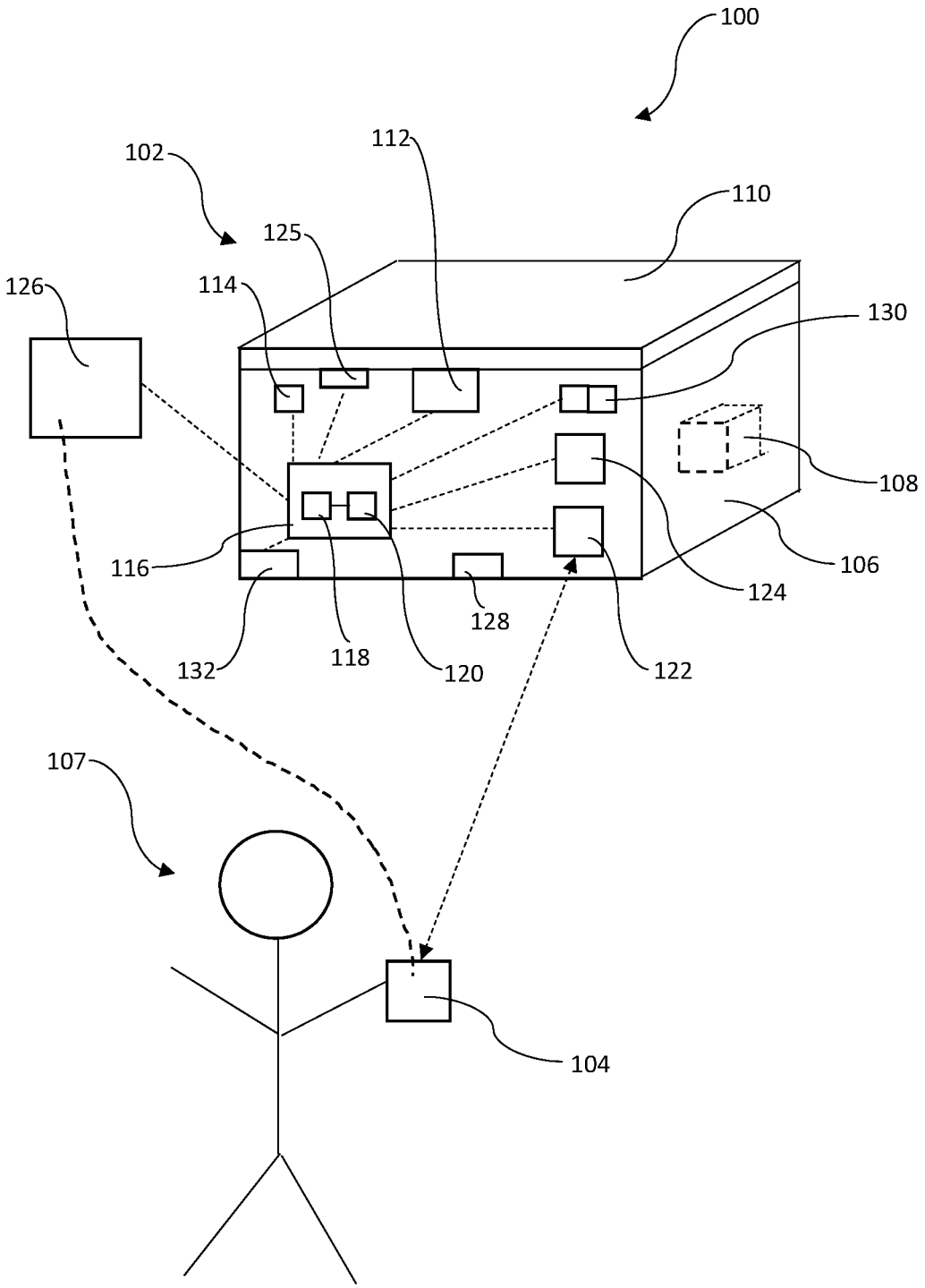
FIG. 1 schematically shows a system incorporating a container according to an example.

FIG. 1 schematically shows a system 100. The system 100 comprises a container 102, and a user device 104 of a user 107.

The container 102 may alternatively be called a box or receptacle. The container 102 comprises a container portion 106 for storing one or more items. The container portion is substantially hollow. One or more items are schematically shown in FIG. 1 at 108, in the container portion 106. The one or more items 108 may comprise one or more parcels, packages, letters or other correspondence, or the like. The one or more items could also comprise other types of items that are to be stored in the container.

A closure is schematically shown at 110. In some examples the closure comprises a lid or door. For conciseness, and in the context of the described example the term lid is used, however it will be understood that the terms "closure" or "door" may equally be applicable throughout. The lid 110 is movable between open and closed positions. In some examples the lid 110 is manually openable and closable. Additionally or alternatively the opening and closing of the lid 110 may be powered or power assisted.

A lock is schematically shown at 112. The lock is operative to be selectively in a locked state or an unlocked state. When the lock 112 is in an unlocked state, the lid 110 may be freely open and closed, for example by a delivery person. Accordingly when the lock 112 is in the unlocked state, the container portion 106 may be accessed, and it may therefore also be considered that the container portion 106 is in an unlocked state. When the lid 110 is closed and the lock 112 is in a locked state, access to the container portion 106 is prevented, and it may therefore also be considered that the container portion 106 is in a locked state. In an example the lock 112 comprises a mechanical lock controlled by a power supply (e.g. power source 128). In an example the lock is in the locked state when no power is supplied to the lock 112, and the lock is placed in the unlocked state when power is supplied to the lock 112. In some examples the power may be supplied to a solenoid in the lock 112 to move the lock 112 to the unlocked state. In such examples a default state of the lock 112 may be locked, so as not to burn out the solenoid.

An input device is schematically shown at 114. The input device may comprise, for example, a button or touch sensitive pad. A user may press or actuate the input device 114 to request access to the container, for example when the lid 110 is closed and the lock 112 is in the locked state. Therefore in some examples the input device 114 may be considered a user actuable input device.

In the example of FIG. 1 a sensor is schematically shown at 124. The sensor 124 is operative to sense whether one or more items (e.g. one or more items 108) is present in the container portion 106. The sensor 124 may comprise one or more of: an optical sensor; a camera; a switch; a weighing scales. The sensor 124 may comprise one or more sensors. It will be understood that in some other examples the sensor 124 is not provided, the presence of one or more items being determined based on stored information of earlier events (described in more detail below).

A communication module or communication device is schematically shown at 122. The communication module 122 enables communication with one or more devices remote from the container 102. For example the communication module 122 may enable wireless communication with, for example, user device 104 of user 107. The user device 104 may for example comprise a mobile phone of the user 107. The user device 104 may also be an alternative computing device such as a tablet, laptop, PC etc. It will be understood that in some examples the user 107 (and consequently user device 104) are at a location different from the container 102. For example the container 102 may be located at a home of the user 107, and at times the user 107 may be at another locations such as at the user's workplace.

To enable communication the communication module 122 may comprise a transmitter and a receiver. The transmitter and receiver may be in the form of one or more antennas. Communication between the communication module 122 and the user device 104 may be direct or indirect. Where the communication is indirect, this may for example be via one or more of a home or office router, and/or one or more base stations. In some examples the container 102 may be considered an Internet of Things (IoT) device. In general, as used herein, an IoT device may be considered a device that has an addressable interface (e.g. an Internet protocol (IP) address, a Bluetooth identifier (ID), a near-field communication (NFC) ID, etc.) and can transmit information to one or more other devices over a wired or wireless connection. Accordingly the container 102 may communicate via communication module 122 with one or more networks according to one or more IoT communication protocols.

A camera is schematically shown at 126. In one example the camera 126 is mounted on the container 102. In another example the camera is located at the location of the container 102, but not physically mounted to the container. For example the camera 126 may be located or mounted on a building, fence, post or other mounting point at the location of the container. The camera 126 may be configured to obtain still images and/or motion picture images. In some examples the camera 126 comprises infra-red capability or has an associated light, for providing visible images in the dark. In some examples the camera 126 is a webcam having a webcam URL.

According to an example, one or more sensors 125 is provided for sensing whether the lid 110 is open or closed. The one or more sensors 125 may comprise a switch. In some examples the one or more sensors 125 is part of the lock 112. The one or more sensors 125 may additionally or alternatively provide information to controller 116 of whether the lock 112 is in the locked state or the unlocked state. Accordingly, in some examples the container 102 comprises one or more sensors 125, the one or more sensors configured for sensing whether the lid 110 is open or closed and whether the lock 112 is locked or unlocked. In some examples the one or more sensors 125 comprises a first sensor for sensing whether the lid 110 is open or closed, and a second sensor for sensing whether the lock 112 is locked or unlocked. In some examples the one or more sensors 125 may be termed "further" sensors, being additional to sensor 124 for sensing whether one or more items is present in the container portion 106.

A visual display is schematically shown at 130. The visual display 130 is arranged to indicate to a user (e.g. delivery person) whether or not the container 102 is locked. For example the display may comprise a green light for indicating when the container is unlocked, and a red light for indicating when the container is locked. In another example illumination of a green light indicates that the container is unlocked, and when the green light is not illuminated this indicates that the container is locked (e.g. there is no need for a red light).

In some examples one or more speakers 132 may be provided for providing an audible output. The audible output may comprise, for example, one or more of: automated instructions for the delivery person; an alarm; an indication of whether or not the container is locked; voice output originating from user 107 via user device 104.

A power source is schematically shown at 128. The power source 128 is configured to provide electrical power to the various aspects of the container 102, as required. Additionally or alternatively the container 102 may be configured for connection to mains electricity.

A controller is schematically shown at 116. In an example the controller comprises a microcontroller (MCU). The controller 116 comprises at least one memory 118 and at least one processor 120. In this example the controller 116 is communicatively connected to the lock 112, input device 114, sensor 124, communication module 122, sensor 125, camera 126, visual display 130, and speakers 132 as schematically shown by the dashed lines.

In some examples the controller 116 does not control or communicate with camera 126. That is in some examples the camera 126 communicates (e.g. image information) with user device 104 independently of controller 116. This is schematically shown by the dotted line between the camera 126 and the user device 104. Communication between the camera 126 and the user device 104 may be direct or indirect. Where the communication is indirect this may be via one or more routers and/or base stations.

In an example the controller 116 is configured such that, in response to actuation of the input device 114 when the container portion 106 is in the locked state, the controller configured to cause a request for access to the container portion 106 to be sent by the communication module 122 to the user device 104 of the user 107 when at least one condition is met. The at least one condition is that one or more items 108 is determined to be present in the container portion 106.

In an example the determining that one or more items is present in the container portion 106 is based on stored information of earlier events. The information may be stored in the memory 118.

In one example the stored information of earlier events comprises information of earlier locking/unlocking activity of lock 112 and opening/closing activity of lid 110. In one example the stored information comprises information that the lock 112 (and consequently container portion 106) has been previously or earlier configured in an unlocked state (which may comprise a transition from the locked state), and that whilst in the unlocked state the lid 110 was opened and then closed. The stored information may also comprise information that after opening and closing of the lid, the lock 112 (and consequently container portion 106) has been returned to a locked state. In an example this information may be obtained from the one or more sensors 125.

In another example the determining that one or more items is present in the container portion 106 is based on information received from the sensor 124.

In some examples it is determined that one or more items is in the container portion 106 based on information of earlier events and information received from the sensor 124.

When the input device 114 is actuated and the at least one condition is not met, then a request for access to the container portion is not sent to the user device 104. For example the controller 116 may be configured such that on condition that no items are determined to be present in the container portion and/or it is determined that the container portion 106 is in an unlocked state when the input device 114 is actuated, a request for access to the container portion 106 is not sent to the user device 104. For example it may be determined that no items are present in the container portion 106 based on stored information of earlier events, or information received from sensor 124, or information that the container has not been opened since the container was last emptied.

Therefore in some examples it may be considered that in response to actuation of the input device 114, a request for access to the container portion 106 is sent to the user device 104 only on condition that it is determined that at least one item 108 is already present in the container portion 106. In some examples a request for access to the container portion 106 is sent to the user device 104 only on condition that the container portion 106 is determined as being in a locked state (i.e. the lid 110 is closed and the lock 112 is locked), and it is determined that at least one item 108 is already present in the container portion 106.

Figure 2:
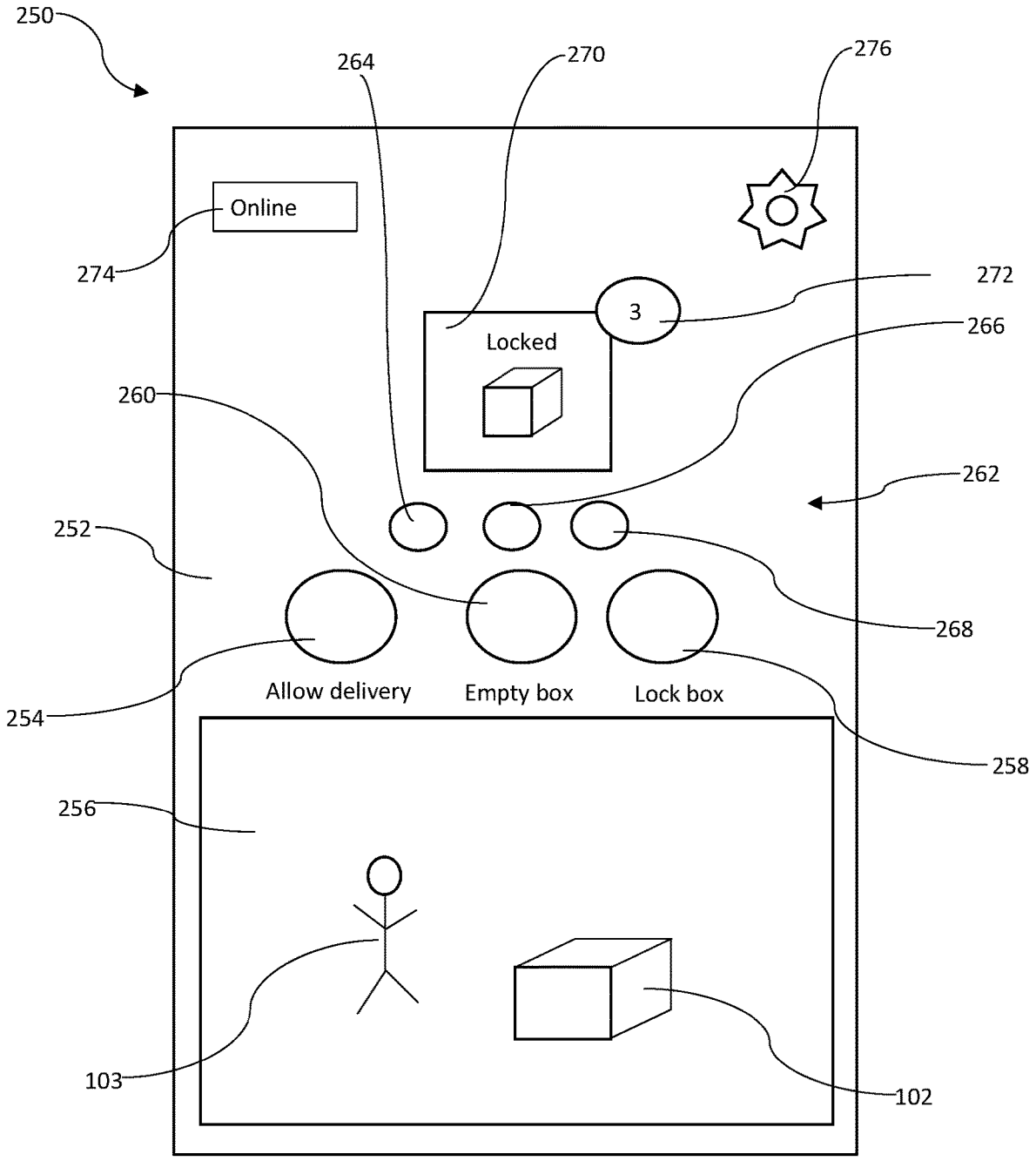
FIG. 2 schematically shows a user interface of a user device application according to an example.
Figure 3:
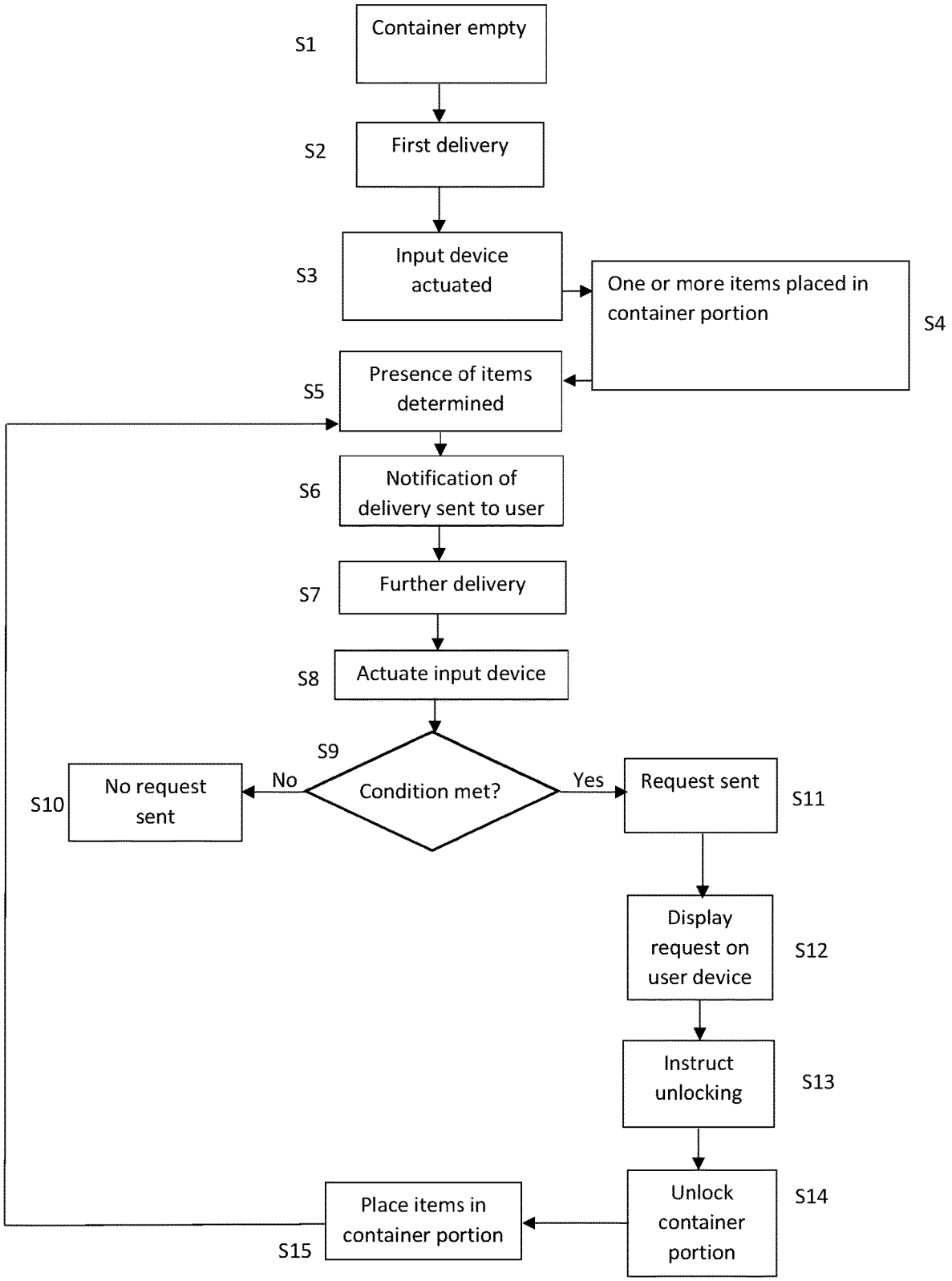
FIG. 3 is a flow chart showing a method according to an example

The invention will now be further described using a worked example and with reference to FIGS. 1 to 3.

Initially, at time t1, the container 102 is empty i.e. no items such as parcels are in the container portion 106. This may be the case, for example, at the beginning of a day before any deliveries have been made. This is shown at S1 in FIG. 3. At this stage the container portion 106 may be in the locked state or the unlocked state. For the purposes of this example, it will be considered that at this stage the container 102 is empty and locked.

At a later time, t2, a delivery person arrives at the location of the container 102 to drop off one or more items, such as one or more parcels. This may be considered a first delivery. This is shown at S2 in FIG. 3.

A set of written instructions may be provided for the delivery person. The written instructions may be located in a prominent position such as proximate to a letterbox of a building at the location, and/or on the container 102 itself. The written instructions may for example inform delivery persons that items which cannot fit through the letterbox are to be placed in the container 102.

From reading the instructions, and/or from information provided by visual display 130, the delivery person understands that in order to open the container 102 to access container portion 106, then actuation of input device 114 is required.

Therefore as shown at S3 the delivery person actuates the input device 114. This causes the lock 112 and container portion 106 to be moved to the unlocked state. Owing to the fact that at this stage no items are sensed as being present in the container portion 106, then no request for access is sent to user device 104. Had the lock been in the unlocked state by default, then at this stage the unlocking would not be required.

Accordingly the delivery person can now simply lift the lid 110 of the container 102, and place the one or more items 108 to be delivered in to the container portion 106. This is shown at S4.

Once the delivery person has placed the one or more items 108 in the container portion 106, the lid 110 is closed and the lock 112 is locked. This information may be obtained by one or more sensors 125, and stored in memory 118.

The locking of the lock 112 may be in response to determining (e.g. by sensor 125) that the lid 110 has been closed. Accordingly the container portion 106 is in a locked condition, preventing access to the one or more items 108. In some examples, the lock 112 is locked immediately after the lid 110 is closed. In other examples, the lid 110 is locked a pre-determined amount of time after the lid 110 is closed. For example, the pre-determined amount of time may be 20 seconds. This gives the delivery person a short amount of time to retrieve the one or more items 108, for example if the delivery person realises that they have placed an incorrect item in the container 102. The pre-determined time may be configurable, for example by the user 107.

Additionally or alternatively, the sensor 124 senses the presence of the one or more items 108 placed in the container portion 106.

Whether by using information of events that have occurred (e.g. locking and unlocking of lock 112 and opening and closing of lid 110), or by using information from sensor 124, or both, the presence of one or more items 108 placed in the container portion 106 is determined. This is shown at S5.

At this point a notification is sent by communications module 122 to user device 104 that a delivery has been made. This is shown at S6.

The information that one or more items is in the container portion may be stored in memory 118.

At a later time, t3, a delivery person brings one or more further items to be delivered. This is shown at S7. This may be considered a second or further delivery. Again, the delivery person (who may be the same or a different person from the earlier delivery person) may read the provided written instructions.

At t3 the lid 110 is in a locked state. This may be displayed on the display 130, for example with a red light or absence of a green light.

Again, observing that the container 102 is locked (and perhaps from reading the written instructions), the delivery person is aware that a request for access to the container is required, by actuating input device (e.g. button) 114.

Therefore, at S8, the delivery person actuates input device 114.

In response to the input device 114 being actuated, at S9 it is determined whether at least one condition is met which is necessary for the request for access to be sent to user device 104 of user 107. In other words it is determined whether there is one or more items already present in the container portion 106. This is shown at S9. S9 may comprise retrieving information from memory 118 of whether one or more items is already present in the container portion 106. Alternatively S9 may include the controller polling the sensor 124 to determine if one or more items is present. S9 may also comprise a determination of whether the lid 110 is closed and the lock 112 is locked.

When the at least one condition is not met (e.g. it is determined that no items are already present), then no request would be sent, as shown at S10. As previously described, in one example the lock 112 may be caused to be unlocked and the container portion placed in the unlocked state, since there is no security risk of items being taken from the container portion 106. In such circumstances the display 130 may provide some visual feedback to the delivery person. For example, the display 130 may be illuminated green to indicate that the container portion 106 has been unlocked.

However, in this example, the at least one condition has been met (one or more items determined to be present in container portion 106), and therefore the request for access is transmitted to the user device 104 of the user 107, as shown at S11. The transmitted request may comprise an electronic signal transmitted from communication module 122 to user device 104.

Subsequently, a request for access to the container 102 is displayed on a user interface of a display of the user device 104, as shown at S12.

FIG. 2 shows such an example user interface 250. A screen 252 of the user interface 250 comprises a plurality of user-selectable icons. One such icon is icon 254, actuation of which (e.g. via a touchscreen) causes a signal to be sent to the communication module 122 of the container 102, instructing the controller 116 to unlock the lock 112. This is shown at S13.

Accordingly lock 112 is unlocked thus enabling access to the container portion 106. This is shown at S14. At this stage the display 130 may also be illuminated green.

The delivery person then places the further one or more items in to the container portion 106 and closes the lid 110, as shown at S15.

The lid 110 may then be locked, presence of (further) items determined and stored, and notification of (further) delivery sent to user device 104. In other words the method may loop back to S5.

Returning to FIG. 2, some aspects of the user interface 250 will now be explained in more detail. The user interface 250 may be part of a downloadable application or "app", in one example.

The user interface 250 comprises a portion 256 which displays images captured by camera 126. This enables the user 107 to see an image of the container 102, and also enables the user 107 to see an image of the surrounding area of the container 102. For example the user 107 may be enabled to see a person 103 attempting to gain access to the container 102. The displayed images may be still images or motion picture images. The images may be streamed and played in real time and/or stored at the user device 104.

In one example, an alert is sent to the user device 104 when a request to access the container 102 is received at the user device 104. The alert may comprise one or more of: an audible alarm through speakers of the user device 104; a visual alarm on the display of the user device 104; a vibration. In some examples, when the request is received at the user device 104 the user interface 250 is automatically displayed on the display of the user device. By looking at the display portion 256, the user 107 can make a judgement as to whether a person 103 requesting access to the container 102 is a trusted person (e.g. appears to be a genuine delivery person and/or is someone known to user 107). Accordingly the user 107 can decide whether to allow the person 103 access to the container 102 by pressing icon 254. In some examples the icon 254 may be highlighted in some way while an access request is pending. For example the icon 254 may pulse or flash, or the container status 270 may display "Delivery Requested".

In some examples the user 107 can call up the user interface 250 at any time, regardless of whether a request for access to the container 102 is received. This enables the user 107 to view the container 102 and surrounding area whenever the user feels is necessary.

Actuation of "lock box" icon 258 enables a user to remotely lock the container 102, at any time.

Actuation of the "empty box" icon 260 enables the user 107 to unlock the container 102 at any time, for example so that the user 107 can gain access to the container 102 to gain access to its contents. In some examples, at this point opening then closing the lid (or optionally determining that all items were removed from the container) would reset the container to empty status as per s1 in FIG. 3. In other words a status of the container may be reset to "empty" in response to determining that items have been removed and the lid closed.

Further icons or images may also be provided on the user interface 250 to provide useful information and/or functionality to the user 107.

For example the row of icons 262 may provide useful status information to the user 107.

For example icon 264 may indicate whether the container 102 is currently locked or unlocked. To this end icon 264 may display a visual representation of a padlock selectively shown closed (to indicate container locked) or open (to indicate container unlocked).

Icon 266 may provide a visual representation of whether the lid of the container 102 is opened or closed. In examples where the lid 110 is a powered lid then the user may be able to control opening and closing of the lid via the user interface 250.

Icon 268 may provide a visual representation of contents of the container 102. For example the icon 268 may provide a visual representation of how full or empty the container 102 is.

Further information may be displayed to user 107 in region 270. For example region 270 may display information such as one or more of: container locked/unlocked; delivery requested, awaiting remote unlock; currently accepting delivery; container currently unlocked for emptying; container disabled.

Region 272 indicates to a user how many items are currently in the container 102. In this example, the region 272 indicates that 3 items are currently in the container 102.

Region 274 indicates whether the communications module 122 is currently connected to the internet (i.e. online), or is currently offline for some reason. If the indication is that the container 102 is offline, then the user 107 can take steps to remedy the offline cause.

A settings icon is shown at 276. By pressing settings icon 276 (or swiping left or right) the user may be taken to a settings screen upon which the user can adjust settings for the container 102. For example the settings screen may enable settings of the camera 126 to be adjusted. For example a user may be enabled to change a direction that the camera is pointing or a level of zoom. The user may also be able to set or adjust the camera URL, where the camera 126 is a webcam. According to some examples, via the settings screen the user can also adjust or perform other settings including one or more of: disable controller; remotely reboot controller; view debug logs; change Wi-Fi settings; delete container from account.

Via the settings screen the user may also be enabled to adjust one or more threshold or predetermined times or timeouts.

For example an adjustable threshold time may comprise a time for which the controller 116 will wait for a response from the user 107 after the user input device 114 has been actuated to request access to the container. Once the predetermined time has expired then the request is cancelled. For example a default for this threshold time may be 120 seconds.

Another adjustable threshold time may comprise a time for which the controller 116 will wait for the lid 110 to be opened after an access request has been granted or an access instruction sent by user 107, before re-locking the lid 110. In some examples the timer is initiated when the lock 112 is placed in the unlocked condition. In some examples this threshold time may differ depending upon the reason for unlocking the container. For example, if access was granted in response to an access request via input device 114 (e.g. activation of the button by a delivery person), then the threshold time may be a first threshold time e.g. 60 seconds. Therefore in one example, if the container is unlocked in response to a request from a delivery person, then upon unlocking the delivery person has 60 seconds in which to access the container 102, before it is automatically re-locked. If on the other hand an access instruction is received from the user device 104 (e.g. selection of "empty box" icon 260), irrespective of whether an access request has been received via input device 114, then the threshold time may be a second threshold time. The second threshold time may be different to the first threshold time. For example the second threshold time may be 120 seconds. Therefore in one example, if user 107 causes lock 112 to be unlocked via user device 104 (e.g. by pressing "empty box" icon 260) then upon unlocking of the lock 112 the user has 120 seconds in which to access the container before the lock 112 is automatically re-locked. In other examples the second threshold time may be the same as the first threshold time.

According to one example, the container comprises a single (i.e. one) lockable lid 110 and a single (i.e. one) container portion 106. Accordingly the container portion 106 can be relatively large, compared to a container of the same external dimensions but having multiple lockable lids and multiple respective container portions. Having a relatively large single container portion may be helpful when the delivery person needs to place one or more bulky items in the container portion. If necessary, the delivery person can re-arrange previously delivered items within the container portion 106 in order to accommodate all items.

The conditional sending of the request for access to the container 102 to the user 107 (on user device 104) may have one or more advantages. For example the conditional sending may be advantageous over, say, a lockable container that is always locked by default and a notification is sent to the user every time someone requests access, even if there are no items already in the container (for the purposes of explanation this may be considered an "unconditional" approach). Such an unconditional approach may inconveniently disturb the owner of the container and unnecessarily use up wireless network resources, for example for the first delivery each day when a request for access is made but there are no items already in the container (and therefore no security risk in giving access to the requester).

According to some further examples, access may be granted to container 102 without the user 107 manually having to authorise each request for access via their device 104. To this end one or more tokens or certificates may be used. This may also enhance security of the container.

Figure 4:
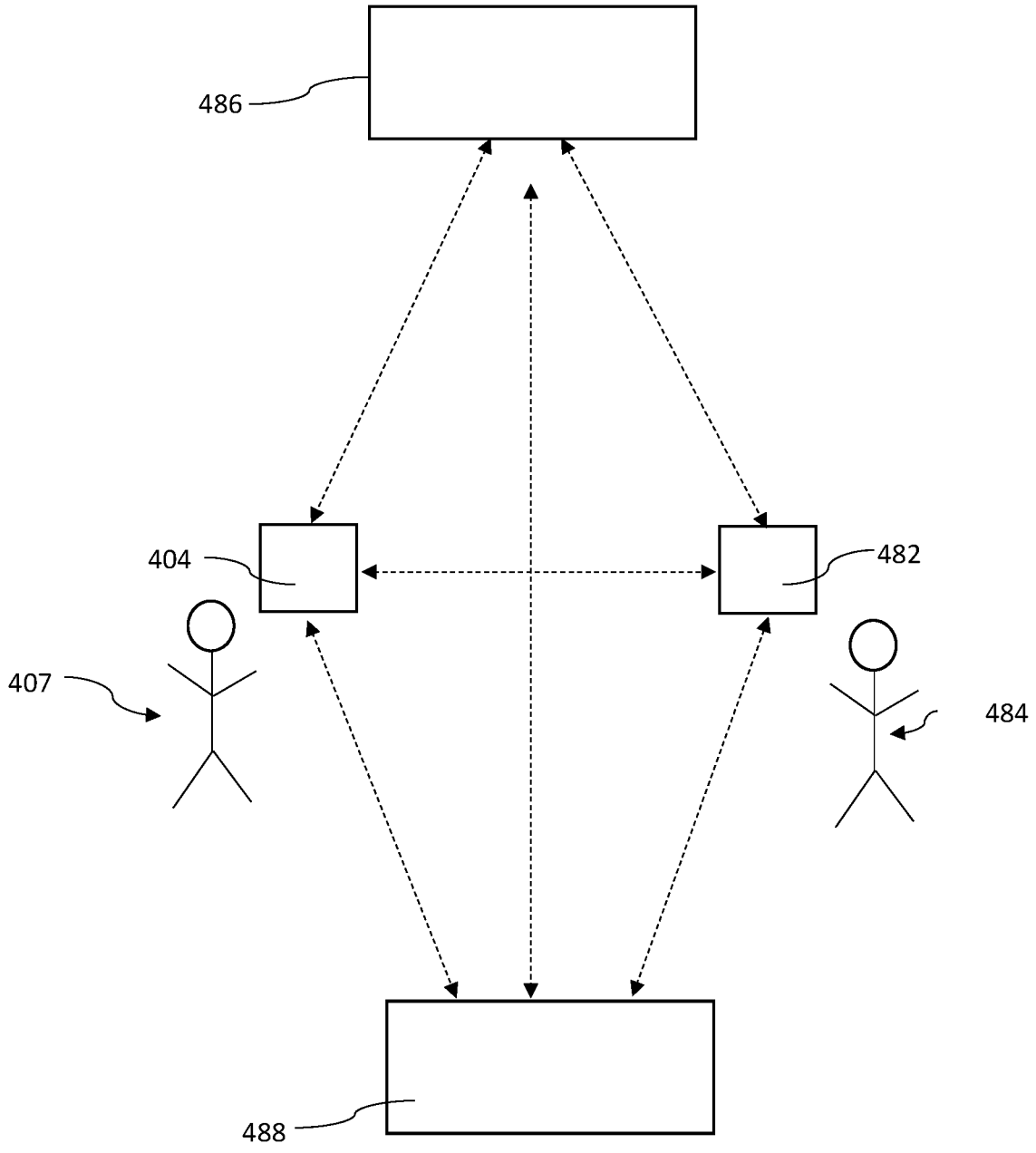
FIG. 4 schematically shows a system according to an example.

FIG. 4 schematically shows an example system for using such a token or tokens (a token may also be referred to as a certificate). A user's device is shown at 404. For example user device 404 may be a user device of the owner or manager of container 102. Such a user is schematically shown at 407. A further user device is shown at 482. User device 482 may for example be a user device of a further person such as a delivery person. Such a person is schematically shown at 484. Generally speaking user devices 404 and 482 may be respectively considered first and second user devices, and users 407 and 484 may be considered respective first and second users. User 484 may also be referred to as a third-party.

A server is schematically shown at 486. Server 486 may be considered a first server. Server 486 is configured to serve user device 404. For example server 486 may host the app. of user device 404 which controls the container 102 (e.g. the app described with respect to FIG. 2). Server 486 may also serve user device 482.

A server is schematically shown at 488. Server 488 may be considered a second server. Server 488 is configured to serve user device 482. For example where user 484 is working on behalf of a particular business (e.g. DHL®), then server 488 may be a server of that business (e.g. a DHL® server). Server 488 may be considered a trusted server. Server 488 may also serve user device 404.

The dashed double-headed arrows represent wireless communication paths between the devices 404 and 482 and servers 486 and 488. The wireless communications paths which are established and/or used may in practice depend upon the particular embodiment. One or more of devices 404, 482 and/or one or more of servers 486, 488 may also communicate wirelessly with communication module 122 of container 102, for example to cause one or more of: locking; unlocking; opening; closing, of the container 102.

Figure 5:
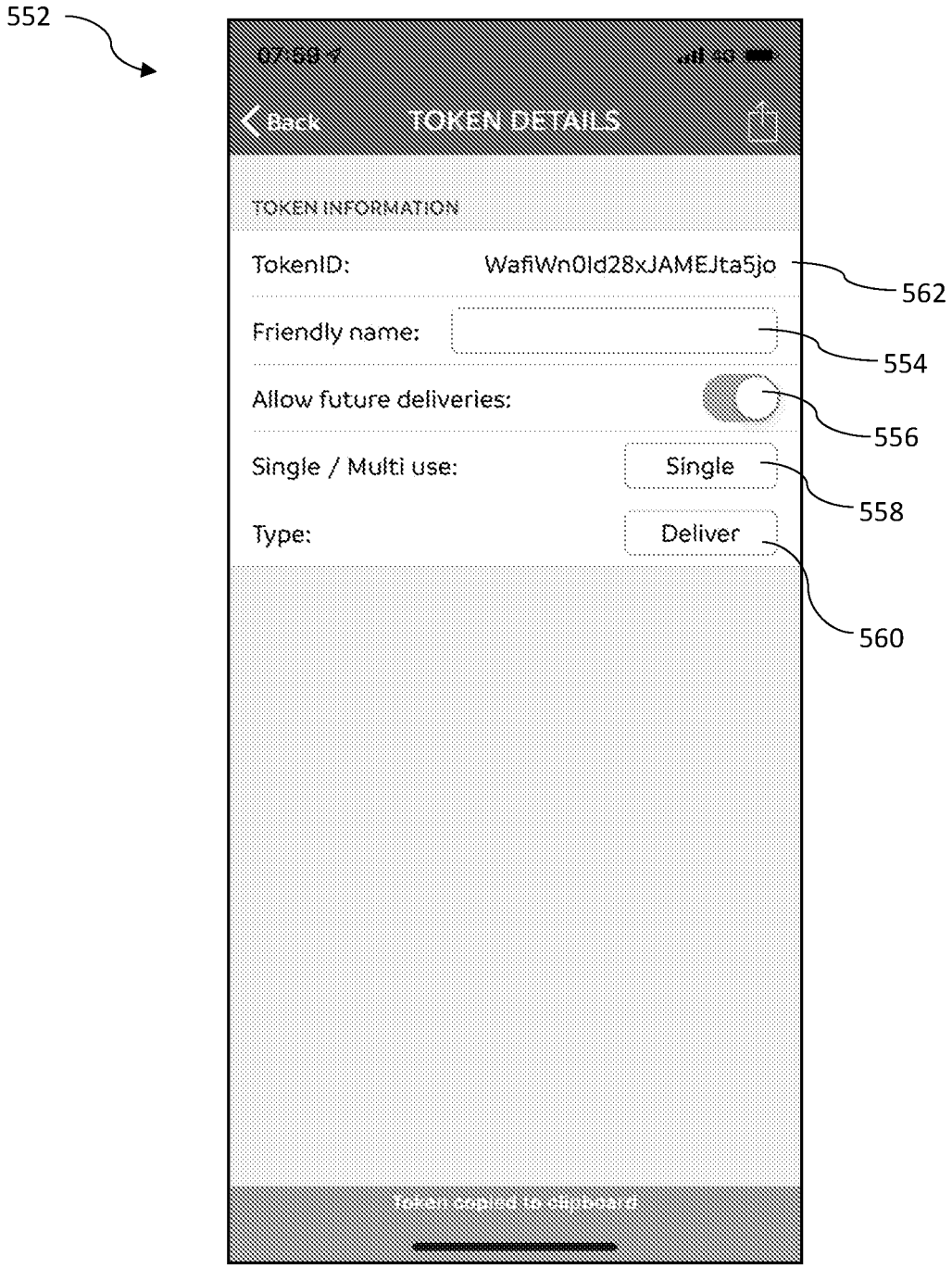
FIG. 5 schematically shows a user interface of a user device application according to an example.

Via user device 404, user 407 can cause a secure access token to be generated for a third party (e.g. for user 484). For example this may be carried out via a user interface of the app. An example UI screen 552 is shown in FIG. 5, which shows some settings that the user 407 may control when generating a token. In field 554 a name for the person or company to whom access is being granted can be set. The user 407 can set whether to allow future deliveries for that person, for example via toggle 556. When toggle 556 is activated (e.g. as shown in FIG. 5) then the user 407 can adjust further settings. For example the user 407 can set whether the token will be single-use or multi-use, as shown at field 558. In some examples, where the token is set to be multi-use then the user 407 can also set how many uses the token allows (e.g. 2, 3, 4, unlimited until token cancelled etc.). The user 407 can also set what type of access the token will permit as shown at 560 e.g. delivery of one or more items; collection of one or more items; both delivery and collection of one or more items; emptying of box contents.

The token ID is shown at 562. After generating of the token at the user device 404, the token is stored. In one example the token is stored at server 486. Additionally or alternatively the token is stored at user device 404. Additionally or alternatively the token is stored at server 488. Where the token is stored at server 488, this may be by way of user 407 securely logging in to server 488 via their device 404 and storing the token at server 488. Alternatively the user 407 may store the token at server 488 by REST API.

User 407 is enabled to share the generated token with a third party. For example information area 564 confirms that the token has been copied to the clipboard, and the user can cause the copied token to be sent to the third party e.g. to user device 482.

In one example the token is sent from user device 404 to user device 482. For example the token may be sent via a text message or another messaging service, or by email. In another example the user 407 may verbally share the token ID with the user 484 e.g. by reading out the token ID shown at 562.

In one example the server 488 may for example host a trusted website via which the user 484 can obtain the token.

Thus it will be appreciated that in some examples the server 488 and/or server 486 can act as an intermediary via which generated tokens can be communicated between user device 404 and user device 482 or server 488, without a need for direct communication between user device 404 and user device 482 or server 488.

In another example the user 407 may allow the app to submit the token directly to a third party such as user device 482. For example a REST API (representational state transfer application programming interface) may be used for this purpose. This may be for a single delivery based on ID/tracking number or for multiple deliveries.

In some examples the user 407 is also enabled to share other details with user 484, such as information of one or more of: address of container; GPS coordinates of container; Bluetooth or other beacon ID of the container). This information may be transmitted from device 404 to device 482. Additionally or alternatively the information may be made available to device 482 e.g. by being transmitted from server 486.

It will be appreciated that in at least some examples the user 484 does not require the container-controlling app which is installed on user device 404 to be installed on user device 482. Rather, the user device 482 only needs to be able to communicate over the Internet to obtain the token from server 488 (or server 486 or user device 404).

Figure 6:
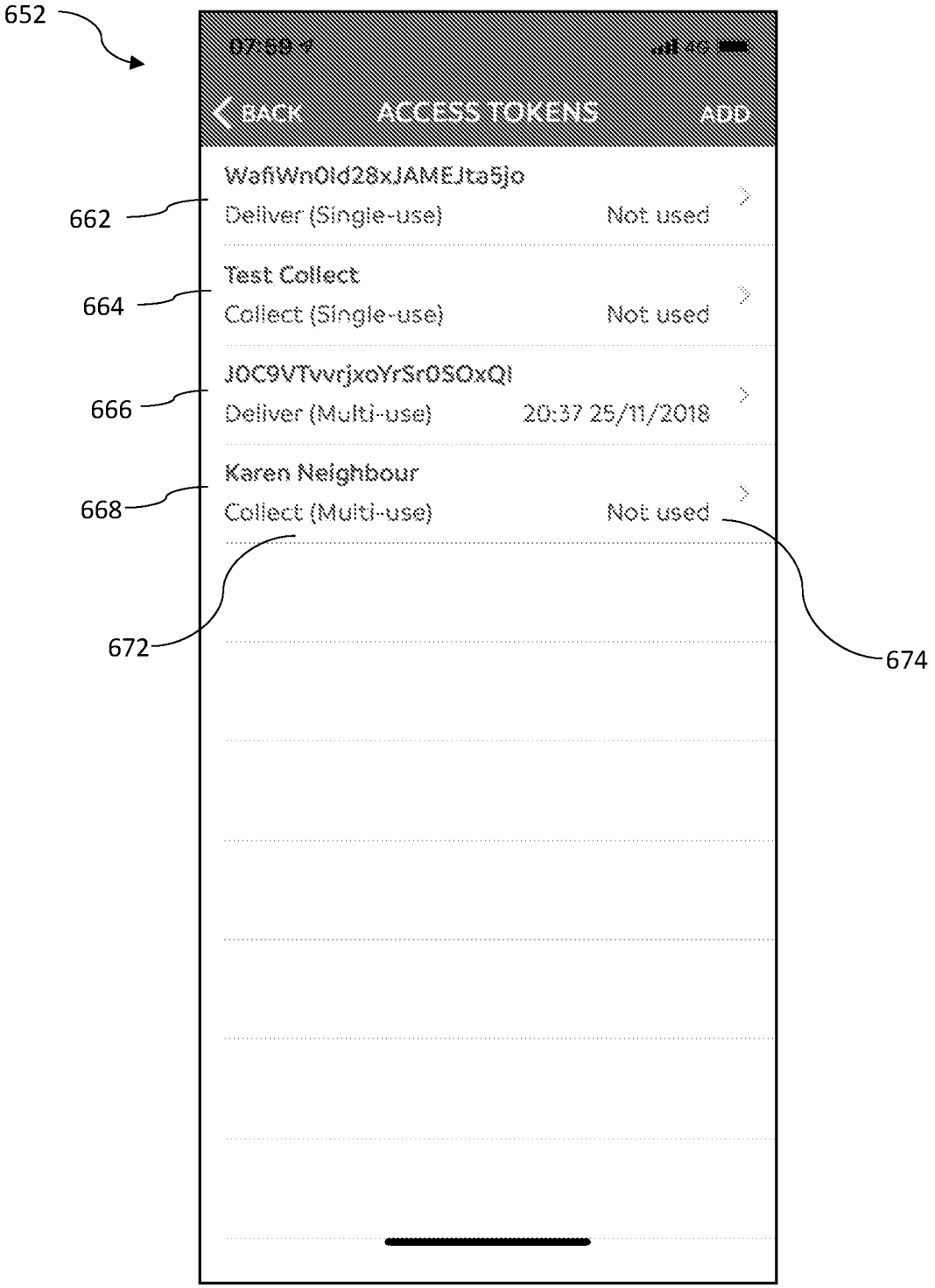
FIG. 6 schematically shows a user interface of a user device application according to an example.

FIG. 6 schematically shows a further UI screen 652 (e.g. of the app), where user 407 can view tokens 662, 664, 666 and 668 that have been made available to third parties. Using token 668 as an example it can be seen that the following fields are displayed: field 670 which displays the ID of the third-party to whom the token has been granted; field 672 which displays whether the token is single use or multi-use; field 674 which displays whether or not the token has been used. In some examples, when a token has been used then a date and time of use is displayed (see token 666 for example).

Figure 7:
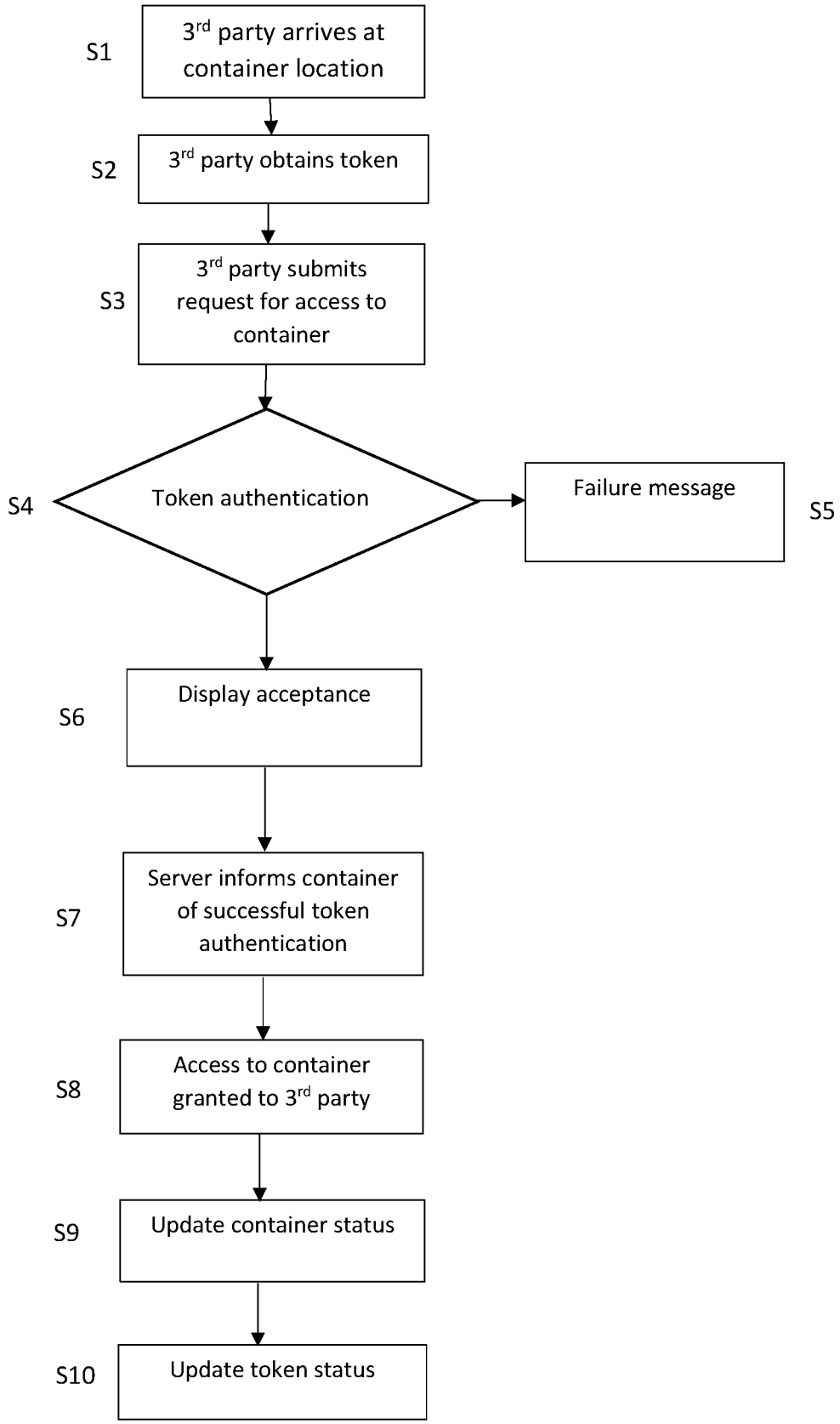
FIG. 7 schematically shows a flow chart of a method according to an example.

FIG. 7 is a flow chart of a method according to an example which provides a practical example of use of a token, in conjunction with FIGS. 1 and 6.

At S1, third-party 484 such as a delivery person or courier arrives at the location of container 102 to perform an action e.g. one or more of: delivery of an item; collection of an item; emptying of container. The third party knows, either through experience or text provided on the container 102 that a token is required in order to access the container 102.

The third-party 484 may already have the token stored to their device 482, or may need to obtain the token. The various ways in which the third-party 484 can obtain the token have been discussed above. Therefore an optional step of the third-party 484 obtaining the token is shown at S2 (optional because if the third-party 484 already has the token then S2 can be omitted).

At S3 the third-party 484 electronically submits a request for access to container 482 by transmitting the necessary token to server 486.

At S4 a token authentication step is carried out at server 488 to check that the token is valid.

If the token is not accepted by server 486, then a failure message may be provided to third-party 484 informing them as such on their user device 482, as shown at S5. In some examples the failure message indicates a reason for failure e.g. token expired, token not authorised, token not found etc.

Figure 8:
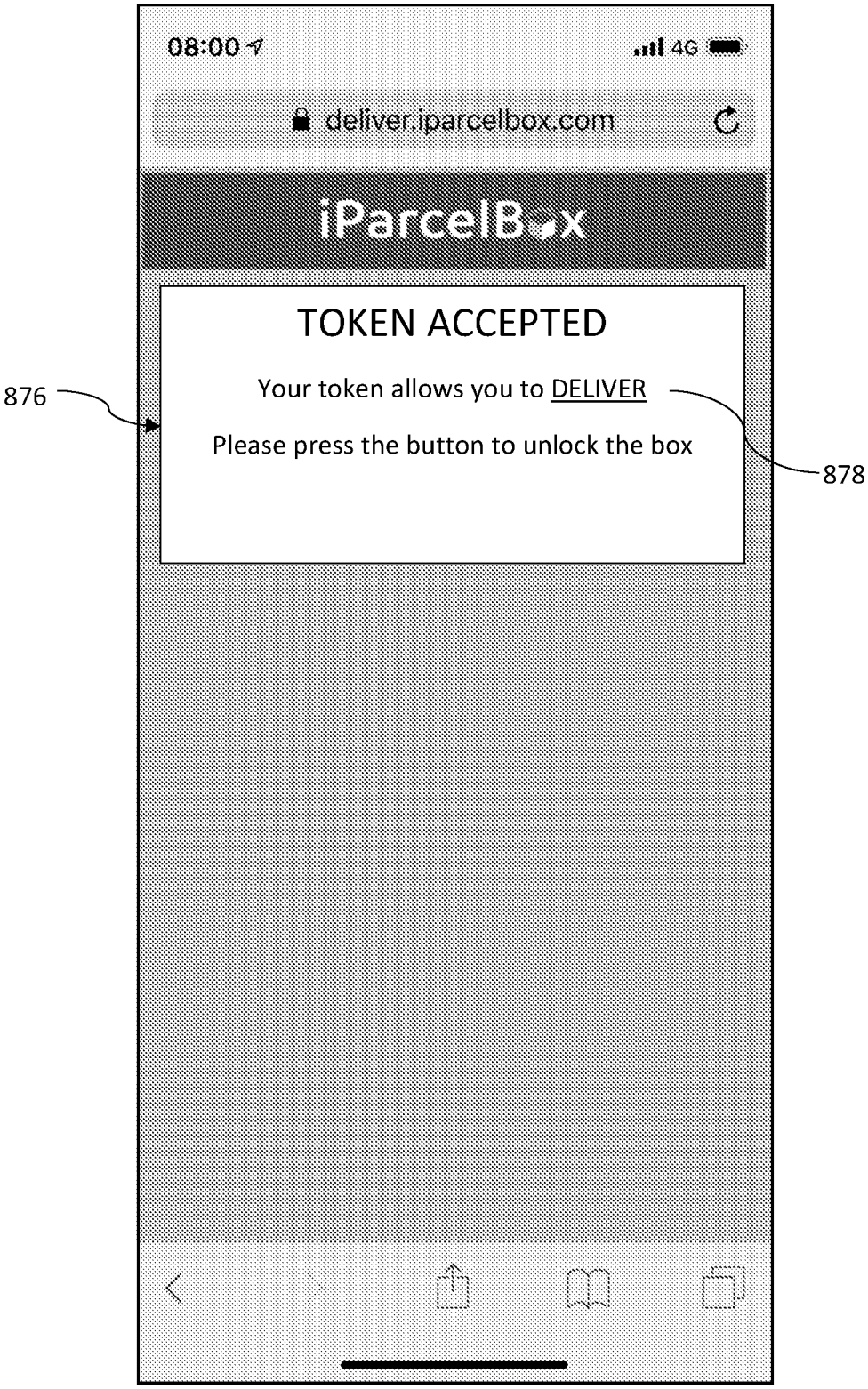
FIG. 8 schematically shows a user interface of a user device application according to an example.

If the token is successfully authenticated at server 486 then the method proceeds to S6 where a confirmation of acceptance of the token is provided to third-party 484. FIG. 8 provides an example of such a confirmation message 876, which may for example be displayed on a display of user device 482. In some examples the confirmation message 876 confirms what access right the token enables, for example one or more of: delivery; collection; emptying of container. In the example of FIG. 8, as shown at 878 the token enables the third-party to deliver.

Following successful authentication of the token, at S7 the server 486 sends a message to container 102 indicative of the successful token authentication. In other words the server 486 informs the container 102 that a valid token has been received.

Following on from S7, at S8 the third-party 484 is granted access to the container 102. In other words the container 102 is unlocked.

S8 may be achieved in different ways. In one example, upon receiving the displayed acceptance at S6, the third-party 484 requests access to the container 102 by actuating the input device 114. The container will then unlock (since it knows from the message at S7 of an impending valid request for access), providing access to the third party to carry out their task. In another example, the container 102 automatically unlocks in response to receiving the message from the server 486 at S7. According to some examples the third-party has a limited time period in which the container will successfully unlock and/or remain unlocked. For example for a certain time period (e.g. 30 seconds, 1 minute etc.) after server 486 has authenticated the token, the container 102 may be caused to accept a request for access received via input device 114. In an example where the container automatically unlocks in response to receiving the message at S7, the container 102 may automatically re-lock after a certain period (e.g. 30 seconds, 1 minute, etc.)

Once the lid of the container has been opened and closed the status of the container 102 will be updated based on the activity type of the token used (e.g. increase parcel count by 1 for a delivery; decrease by 1 for a collection; set to zero for empty, etc.). This is shown at S9 in FIG. 7. The status information may for example be updated at the server 486 and/or the user device 407.

At S10 the status of the token is updated to record details of the token use, for example to prevent re-use of a single-use token. The token status may be updated at one or more locations where information of the token is stored, for example one or more of: user device 404; server 486; server 488; user device 482.

It will of course be understood that the method described with respect to FIG. 7 is exemplary, and that one or more additional or alternative steps are envisaged.

For example, rather than the third-party 484 pressing the input-device 114 on the container 102 to request access, instead the container 102 may be configured to detect proximity of an authorised third-party at the container's location, and to cause the container to open automatically e.g. via a powered actuator or powered hinge supporting the lid, in response to the proximity detection. For example a Bluetooth®, Wi-Fi® or other short-range communication method may be used to detect proximity and verify a rightful third-party. For example the verification may comprise receiving a valid token over Wi-Fi® or Bluetooth®. On detecting placing or removal of an item, for example using sensor 124, the powered actuator or hinge may automatically close the lid, and the container 102 may be locked. The token may then be recorded as used and the container status updated.

In another example, the third-party 484 and third-party's user device 482 may be replaced by an unmanned mobile device such as an unmanned aerial vehicle (UAV) or drone, or a robot (in such examples the unmanned mobile device may effectively be considered as the user device 482 or comprising the functionality of the user device 482). In examples comprising an unmanned mobile device, the unmanned mobile device may be configured to scan a unique barcode located on the container 102, and send information derived from the barcode along with the token at S3 in FIG. 7. If the token is verified then the container lid may be automatically opened using a powered actuator or hinge, enabling the unmanned mobile device to make a delivery or collection or empty the container. On detecting placing or removal of an item, for example using sensor 124, the powered actuator or hinge may automatically close the lid, and the container 102 may be locked. The token may then be recorded as used and the container status updated.

It will be understood that the system shown for example in FIG. 4 provides a secure way of generating, sharing, and using tokens, for secure access to the container 102. The system also provides a number of ways in which one or more tokens can be shared from a token generating device (e.g. device 404), to a token using device (e.g. device 482). For example the system enables direct device-to-device sharing of a token, as well as indirect sharing via one or more secure servers. In some examples the direct or indirect methods are configurable based upon use case. For example an owner of a first device 404 can decide whether the second device 482 (and therefore a third-party) can obtain the token directly or must do so via a secure server.

It will also be understood that if there was a brute force attack on the token server (e.g. server 486 or server 488) and the hacker successfully guessed a token, the container wouldn't unlock unless the attacker was standing next to the container and pressing the input device 114 or receiving and re-submitting the device code.

Although in FIG. 1 a single container 102 and a single user 107 are shown, it will be understood that the system may comprise multiple such containers and/or multiple respective users. It will also be understood that in some examples one user may be enabled to control two or more such containers. It will also be understood that in some examples a container may be controllable by two or more different users via two or more respective different user devices.

It will be understood that for each delivery there may be considered to be two or more "requests for access" to the container portion 106. The request for access by the delivery person actuating input device 114 may be considered a first request for access. The subsequent (and conditional) request for access sent by the communication module 122 to user device 104 may be considered a second request for access, for the purposes of differentiation.

In some examples users registers themselves and their user devices with one or more respective containers, prior to putting the one or more containers in to use for accepting deliveries. Accordingly when a request for access is received at a container, the controller of the container knows to which user device(s) to send the request for access. Likewise, in examples a container will only accept an unlocking instruction from a user device to which that container is registered.

For the registration process, in an example the user device 104 app contains a setup routine to allow the user to connect controller 116 to the user's home or office Internet router by either providing the router SSID and password within the app or by automatically connecting the controller to the same network that the user device 104 is currently connected to. Additionally the user device 104 app may have an association process to connect the user device 104 to a particular controller 102 by scanning a QR barcode or by entering a unique serial number and password for the controller 102 (both of which may be provided with the container 102 in paper form).

It will be understood that features from one or more of the described examples may be combined. For example, the conditional sending of the request for access to the container 102 to the user 107 (on user device 104) primarily described with respect to FIGS. 1 to 3 may be combined with the token functionality that is primarily described with respect to FIGS. 4 to 8. For example there may be an example where the controller 116 causes a request for access to the container portion to be sent by the communication module 122 to the user device 104 of a user 107 when at least two conditions are met, the at least two conditions being that: one or more items is determined by the controller to be present in the container portion; and a valid token has been presented by a third party wishing to access the container 102.

It will be understood that the processor or processing system or circuitry referred to herein may in practice be provided by a single chip or integrated circuit or plural chips or integrated circuits, optionally provided as a chipset. The chip or chips may comprise circuitry (as well as possibly firmware) for embodying at least one or more of a data processor or processors, a digital signal processor or processors, baseband circuitry and radio frequency circuitry, which are configurable so as to operate in accordance with the exemplary embodiments. In this regard, the exemplary embodiments may be implemented at least in part by computer software stored in (non-transitory) memory and executable by the processor, or by hardware, or by a combination of tangibly stored software and hardware (and tangibly stored firmware).

Reference is made herein to data storage for storing data e.g. memory. This may be provided by a single device or by plural devices. Suitable devices include for example a hard disk and non-volatile semiconductor memory (e.g. a solid-state drive or SSD).

Although at least some aspects of the embodiments described herein with reference to the drawings comprise computer processes performed in processing systems or processors, the invention also extends to computer programs, particularly computer programs on or in a carrier, adapted for putting the invention into practice. The program may be in the form of non-transitory source code, object code, a code intermediate source and object code such as in partially compiled form, or in any other non-transitory form suitable for use in the implementation of processes according to the invention. The carrier may be any entity or device capable of carrying the program. For example, the carrier may comprise a storage medium, such as a solid-state drive (SSD) or other semiconductor-based RAM; a ROM, for example a CD ROM or a semiconductor ROM; a magnetic recording medium, for example a floppy disk or hard disk; optical memory devices in general; etc.

The examples described herein are to be understood as illustrative examples of embodiments of the invention. Further embodiments and examples are envisaged. Any feature described in relation to any one example or embodiment may be used alone or in combination with other features. In addition, any feature described in relation to any one example or embodiment may also be used in combination with one or more features of any other of the examples or embodiments, or any combination of any other of the examples or embodiments. Furthermore, equivalents and modifications not described herein may also be employed within the scope of the invention, which is defined in the claims.

The invention claimed is:

1. A container comprising:

a container portion for storing one or more physical items, the container portion being accessible via a movable closure;

an input device configured to be actuated by a first user;

a lock configured to selectively place the container portion in a locked state or an unlocked state;

a communication module for communicating with a user device of a second user, the user device of the second user comprising a computing device that is separate from the container; and a controller, wherein:

the controller is configured such that, in response to actuation of the input device when the container portion is in the locked state and before one or more additional physical items are placed in the container portion, the controller causes a request for access to the container portion to be sent by the communication module to the user device of the second user only on condition that one or more physical items are determined by the controller to be already present in the container portion at the time of the actuation of the input device; and the controller is configured such that, when a response to the request for access received at the communication module from the user device grants access to the container portion, the controller causes the container portion to be placed in the unlocked state, thereby enabling placement of the one or more additional physical items in the container portion.

2. The container according to claim 1, the controller configured to determine that the one or more items are present in the container portion based on stored information of earlier events.

3. The container according to claim 2, the stored information of earlier events comprising information that the container portion has been previously placed in the unlocked state, and whilst in the unlocked state the closure has been opened and closed.

4. The container according to claim 1, comprising a sensor configured to sense whether the one or more items are present in the container portion, the controller configured to determine that the one or more items are present in the container portion based on information received from the sensor.

5. The container according to claim 4, the sensor comprising one or more elements selected from among the following elements: an optical sensor; a camera; a switch; and a weighing scale.

6. The container according to claim 1, the controller configured to place the container portion in the unlocked state for a first predetermined time period when the response from the user device grants access to the container portion, and to return the container portion to the locked state after the first predetermined time period has expired.

7. The container according to claim 6, the communication module configured to receive an instruction from the user device to place the container portion in the unlocked state irrespective of whether the input device has been actuated, the controller configured to place the container portion in the unlocked state for a second predetermined time period in response to receiving the instruction, the second predetermined time period being different than the first predetermined time period.

8. The container according to claim 1, the communication module configured to receive an instruction from the user device to place the container portion in the unlocked state irrespective of whether the input device has been actuated, the controller configured to place the container portion in the unlocked state in response to receiving the instruction.

9. The container according to claim 1, the controller configured to retain the container portion in the locked state, when a response from the user device denies access to the container portion or when there is no response from the user device.

10. The container according to claim 1, the controller configured to place the container portion in the unlocked state in response to actuation of the input device without communicating with the user device of the second user, when it is determined by the controller that no items are present in the container portion.

11. The container according to claim 1, comprising a camera configured to obtain one or more images of the container and/or a surrounding area of the container, the camera configured to make the obtained images available for transmission to the user device of the second user.

12. The container according to claim 1, the input device comprising a button or a touch-sensitive pad.

13. The container according to claim 1, comprising only a single closure and only a single container portion.

14. The container according to claim 1, wherein the controller is configured to enable access to the container portion, in response to authentication of a token.

15. The container according to claim 1, the controller configured to place the container portion in the unlocked state in response to detecting proximity of an authorized device.

16. The container according to claim 1, the user device comprising a user interface via which the second user can perform one or more steps selected from among the following steps: grant or deny access to the container portion in response to a received request for access to the container portion; configure the container portion in the locked state or the unlocked state irrespective of whether a request for access to the container portion has been received; view images of the container and/or a surrounding area of the container; obtain information of a quantity of items in the container portion; and adjust one or more settings of the container.

17. The container according to claim 1, further comprising a visual display configured to indicate to the first user whether the container is in the locked state or the unlocked state.

18. A method comprising:

receiving user input from a first user at an input device of a container that is in a locked state;

in response to the user input, causing a request for access to a container portion of the container to be sent to a user device of a second user only on condition that one or more physical items are determined to be present in the container portion; and causing the container portion to be placed in an unlocked state, when a response to the request for access received at a communication module of the container from the user device grants the first user access to the container portion.

19. The method according to claim 18, the determination that the one or more physical items are present in the container portion comprising using stored information of earlier events, the stored information comprising information that the container portion has been previously placed in an unlocked state, and whilst in the unlocked state a closure of the container portion has been opened and closed.

20. The method according to claim 18, comprising sending a notification to the user device of the user when it is determined that the one or more physical items have been placed in the container portion.

21. A non-transitory computer-readable medium having stored thereon a computer program adapted to perform the method of claim 18 when the program is run on a data processing apparatus.

* * * * *